US005926855A

United States Patent [19]

Brodbeck

[11] Patent Number: 5,926,855

[45] Date of Patent: Jul. 27, 1999

[54] ADJUSTABLE ELASTIC PROTECTIVE EYEWEAR STRAP

[76] Inventor: Ralph Brodbeck, 6782 Harrison Ave. #89, Cincinnati, Ohio 45247

[21] Appl. No.: 09/003,393

[22] Filed: Jan. 6, 1998

[51] Int. Cl.[6] ..... A61F 9/00; A61F 9/02

[52] U.S. Cl. ..... 2/426; 2/11

[58] Field of Search ..... 2/15, 13, 11, 426, 2/431, 438, 439, 440, 442, 445, 337, 338, 341, 342; 351/43, 140, 142, 143, 146, 147, 148, 150, 151, 156; 24/3.3, 3.4, 3.8, 68 T, 712, 712.1, 713.6, 115 R, 122.3

[56] References Cited

U.S. PATENT DOCUMENTS

| | | |
|---|---|---|
| 2,264,351 | 12/1941 | Willson . |
| 2,491,216 | 12/1949 | Schlumbohm . |
| 2,660,092 | 11/1953 | Bloom . |
| 3,397,026 | 8/1968 | Spina . |
| 4,818,094 | 4/1989 | Lyons . |
| 4,881,803 | 11/1989 | Giles et al. . |
| 4,953,967 | 9/1990 | Somerville . |
| 5,019,000 | 5/1991 | Stephens . |
| 5,087,118 | 2/1992 | Gill . |
| 5,191,363 | 3/1993 | Smith . |
| 5,313,671 | 5/1994 | Flory . |
| 5,366,072 | 11/1994 | Goldenberg . |
| 5,390,036 | 2/1995 | Flory . |
| 5,406,340 | 4/1995 | Hoff . |
| 5,541,676 | 7/1996 | Pallat . |
| 5,575,042 | 11/1996 | Kalbach . |
| 5,664,291 | 9/1997 | Stoller . |
| 5,687,837 | 11/1997 | Seiler . |
| 5,706,526 | 1/1998 | Huang . |
| 5,706,527 | 1/1998 | Kita et al. . |
| 5,711,036 | 1/1998 | Kita et al. . |
| 5,781,273 | 7/1998 | Boden . |

OTHER PUBLICATIONS

Bunjeez Elastic Lace System Product Literature, (no date).

*Primary Examiner*—John J. Calvert
*Assistant Examiner*—Shirra L. Jenkins
*Attorney, Agent, or Firm*—Wood, Herron & Evans, L.L.P.

[57] ABSTRACT

An adjustable elastic protective eyewear strap for swimwear goggles and the like includes an elongated elastic cord having an elastic core encased in a stretchable cover. The goggle strap uses a releasable lock providing quick and convenient length adjustment for the goggle strap. The goggle strap is used in conjunction with a pair of goggles to provide a dependable and durable method for securing the goggles to the user's head.

4 Claims, 1 Drawing Sheet

ADJUSTABLE ELASTIC PROTECTIVE EYEWEAR STRAP

FIELD OF THE INVENTION

This invention relates to an adjustable elastic strap and fastener suitable for securely retaining protective eyewear, such as swim goggles, to the head of the wearer.

BACKGROUND OF THE INVENTION

A variety of activities are safer and more enjoyable when they are performed with some form of eye protection. Eye protection is used routinely for activities such as swimming, snow skiing, welding and the like. Swimmers, for instance, often find it beneficial to their performance if they swim with the aid of swim goggles. Not only do these swim goggles help keep the chlorine and salt out of a swimmers' eyes, they also help swimmers to see the proper course they wish to traverse. Likewise snow skiers frequently use ski goggles to keep the cold wind, snow, drizzle, and ice out of the their eyes while skiing down the slopes.

These protective goggles typically are secured onto the head of the wearer by an elastic strap. This strap is attached to either side of the goggles and then placed around the wearer's head. The strap usually includes some form of adjustment which allows the goggles to be conveniently fitted to wearers having different sized heads.

Generally the strap used on a pair of swim goggles is made from an elastic material, such as rubber or silicone, much like a general purpose rubber band. The elastic band is laced through holes located on either side of the goggles, forming a single semicircular loop suitable for slipping over the user's head. Simple frictional slide adjusters are employed to facilitate size adjustments for the band.

The known elastic band designs, however, have several disadvantages. Swimmers need to adjust the length of the band to assure proper fit and securement of the goggles to their heads. Known frictional slide adjusters are difficult to manipulate, leading to the inability to quickly and efficiently adjust the size of the strap to properly fit the swimmer's head. Because of this, proper fit is often not achieved. As a result, the goggles are often either too tight or too loose, leading to either discomfort or loss of the goggles altogether. Additionally, because the known elastic bands are typically not exceptionally strong, over-tightening the band often results, causing it to break while being put on or during use. Also, the integrity of the typical rubber or silicone band diminishes with prolonged exposure to sunlight, salt, chlorine and the like. Such exposure weakens the bands and ultimately causes failure. The deterioration is so aggressive that frequent competitive swimmers, such as high school and college swim team members, often must replace the band as many as two to three times a year.

SUMMARY OF THE INVENTION

An object of this invention is to provide an elastic strap that is easy to attach to protective goggles, simple to adjust to different sized heads, and remains adjusted and securely in place on the wearer's head once adjusted.

Another object of this invention is to provide an elastic goggle strap that is durable, not easily damaged by misuse, and unaffected by exposure to sunlight, salt, and chemicals such as chlorine.

The present invention, in accordance with a preferred embodiment achieves these objectives via an elastic adjustable protective eyewear strap which includes an elastic cord used in conjunction with a cord lock to provide length adjustment. The elastic cord which can be implemented on a wide variety of protective eyewear such as swimmers goggles, ski goggles, industrial safety glasses and the like, includes an elastic core provided with a stretchable cover which terminates at first and second ends. A selectively releasable cord lock with a throughhole through which the ends are threaded forms a loop of selectively variable size, providing the requisite size adjustment. The free ends of the covered elastic core are first threaded through apertured tabs attached to opposite sides of the goggles, and then threaded through the throughhole of the cord lock. This arrangement forms two approximately semicircular loops for placing around the head of the user.

In accordance with a further aspect of the invention, the stretchable cover is nylon mesh, and extends beyond the ends of the elastic core which it encases. To prevent fraying of the nylon mesh extensions, heat is applied to their outer ends, causing the mesh to melt. Upon solidification, the ends are protected against fraying. The nylon cover extensions, since they extend beyond the ends of the elastic core, have a reduced diameter as compared to that of the covered core, permitting the opposite ends of the strap to be readily threaded through the throughhole in the adjustable lock and the apertured goggle tabs.

The advantages and other features of the invention will become more fully apparent from the following detailed description and the accompanying drawings.

DETAILED DESCRIPTION OF THE INVENTION

Figure 1:
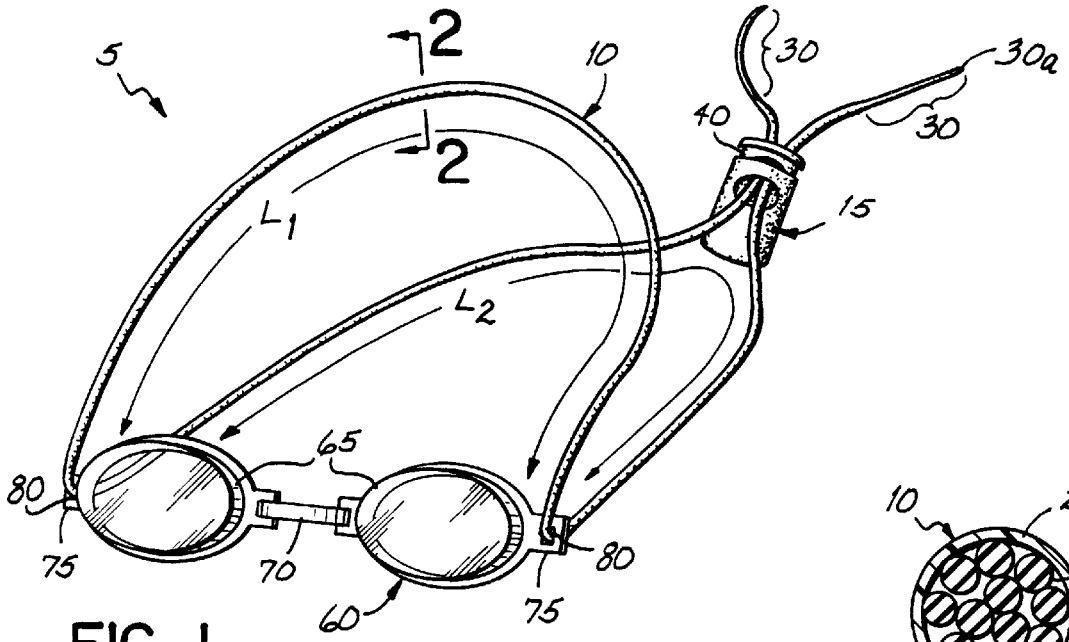
FIG. 1 is a schematic representation of the goggle strap used in conjunction with swim goggles.
Figure 2:
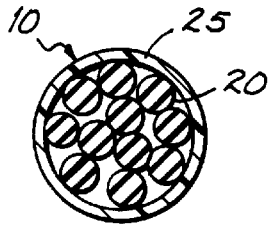
FIG. 2 is a cross sectional view taken along lines 2—2 of FIG. 1.

As shown in FIG. 1, the preferred embodiment of the elastic adjustable protective eyewear strap 5 of this invention includes a covered elastic cord 10 and a cord lock 15. As best illustrated in FIG. 2, the elastic cord 10 is made up of an elongated elastic core 20 and a stretchable mesh cover 25. Although FIG. 2 shows the cross-section of the elastic core 20 as circular, the elastic core 20 can be of any suitable cross-section such as trapezoidal or rectangular. The elastic core 20 can be made of any elastomeric compound which provides sufficient strength and durability. Preferably, the elastic core 20 is made from natural rubber. In the present invention, the core 20 of the cord 10, also sometimes referred to as shock cord or bungee cord, is made up of 9–15 interwoven rubber strands. While the diameter of the cord can vary with the application of the strap 5, a cord diameter of at least ⅛" is preferred.

The elastic core 20 is encased in a tubular mesh cover 25 to protect the elastic core. The cover 25 is flexible and by reason of its mesh construction can stretch or lengthen as the elastic core 20 lengthens. In addition, the cover 25 is unaffected by misuse typically encountered, and will not deteriorate when repeatedly exposed to sunlight, salt, chlorine and the like. Preferably, the mesh cover 25 is made of nylon. In a presently preferred embodiment, the cover 25 extends some distance beyond each end of the elastic core 20, forming extensions or tips 30 of reduced diameter. To prevent fraying of the outer ends 30*a* of the tips 30 during use, sufficient heat is applied to the end of each tip 30 to melt the tip ends 30*a*, providing finished fray-free ends to the cover 25.

Figure 4:
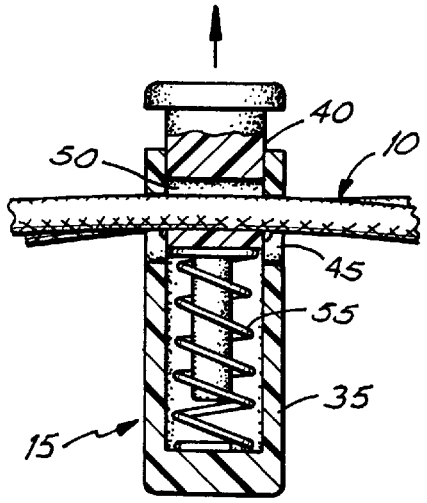
FIG. 4 is a cross sectional view of the lock used to provide easy adjustment to the strap's length.

The cord lock 15, as shown in FIG. 4, includes a housing 35 and a plunger 40. The housing 35 contains therein a throughhole 45, and plunger 40 also contains a throughhole 50. Throughholes 45 and 50 are substantially of the same dimensions. Cord lock 15 also includes a spring 55 which connects plunger 40 to housing 35. The plunger 40 is normally biased by the spring 55 such that throughholes 45 and 50 are not aligned. To align throughholes 45 and 50, the plunger 40 and housing 35 are pushed together until the throughholes 45 and 50 are aligned. When throughholes 45 and 50 are aligned, at least two sections of the cord 10 can pass through the throughholes. After releasing the plunger 40 and the housing 35, the sections of cord 10 passing through the throughholes 45 and 50 are frictionally gripped and locked it their respective positions as the spring 55 attempts to misalign throughholes 45 and 50. The throughholes 45 and 50 in their unaligned positions act like a frictional cord gripping element which are normally biased against the cord 10 for selectively releasably inhibiting the sections of the cord 10 from passing through the lock when the cord 10 is in an adjusted position relative thereto and the gripping element is in a released condition.

Figure 3:
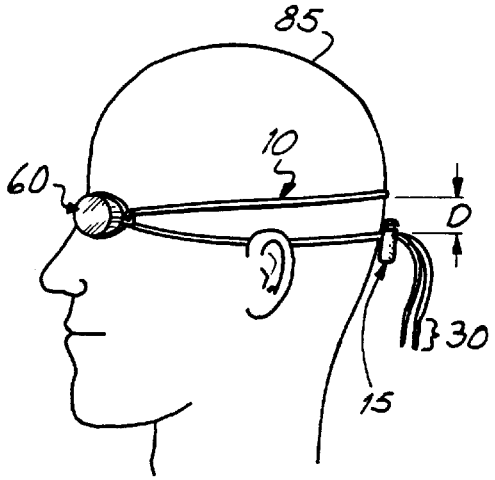
FIG. 3 is a perspective view of a pair of swim goggles equipped with the strap of this invention shown in use placed around a swimmer's head.

The strap 5 is used in conjunction with a pair of goggles 60. Generally, any standard goggle that affords protective cover for the user's eyes can be provided with the strap 5. For instance, swim goggles, ski goggles, industrial safety glasses such as for welding or machining, and the like are contemplated for use with the strap of the present invention. While the strap 5 can be used with several different kinds of goggles, the present invention is especially suited for, but not limited to, swim goggles. The goggles 60 of FIG. 1 are representative of swim goggles. The goggles 60 are generally made of an opposed pair of transparent eye shields 65 which are shaped to conform to the area surrounding the wearer's eye. The eye shields 65 are attached to one another with a connecting strap 70. Each transparent shield 65 has a least one apertured tab 75 provided with a throughhole 80 located at the outside edge thereof. Opposite ends 30*a* of the strap 5 are threaded through the throughholes 80 of the opposite tabs 75. The ends are then both threaded through throughholes 45 and 50 in cord lock 15 until a sufficient length of each end of the strap 5 is passed through the cord lock 15, forming two semicircular loops L1 and L2. The two loops are now ready for placement around the wearer's head 85 as illustrated in FIG. 3. The strap is now adjusted to the wearer's head by temporarily depressing the plunger 40 of the cord lock 15 and pulling the ends 30 of the strap to shorten the loops L1 and L2 as desired to cause them to snugly grip the wearer's head. When the appropriate degree of snugness has been achieved, the plunger 40 is released to frictionally grip and lock the strap sections passing through the lock 15 in their respective adjusted positions. The loops L1 and L2 of the strap 5 are preferably separated at the back of the wearer's head 85 a comfortable distance D to provide maximum stability during use.

What is claimed is:

1. An elastic strap for securing goggles having apertures on opposite sides thereof comprising:

an elongated elastic cord with first and second ends, including an elongated elastic core having first and second ends, and a stretchable nylon-mesh cover having first and second ends and encasing the elongated elastic core, the first and second ends of the cover extending beyond the first and second ends of the elastic core to form first and second tips having a diameter less than a diameter of the elastic core, the first and second tips having been heated to a molten state and thereafter cooled to solidify the tips to thereby prevent fraying of each tip, the elastic core being formed of a plurality of individual strands made of natural rubber; and a selectively releasable cord lock having a housing and a plunger, the housing and the plunger both having throughholes through which the first and second ends of the cord are threaded for substantially forming the elastic cord into two semicircular loops when the elastic cord is inserted through the apertures on the opposite sides of the goggles;

the plunger being spring-biased to misalign the plunger throughhole and the housing throughhole to selectively frictionally grip, and thereby selectively releasably inhibit, the sections of the cord passing through the cord lock in an adjusted position relative thereto.

2. The elastic strap of claim 1 wherein the elastic core is formed from about 9 to about 15 individual strands.

3. A pair of goggles comprising:

an opposed pair of transparent eye shields sized to cover the wearer's eyes, each shield includes an apertured tab with a throughhole;

an elongated elastic cord with first and second ends, including an elongated elastic core having first and second ends, and a stretchable nylon-mesh cover having first and second ends and encasing the elongated elastic core, the first and second ends of the cover extending beyond the first and second ends of the elastic core to form first and second tips having a diameter less than a diameter of the elastic core, the first and second tips having been heated to a molten state and thereafter cooled to solidify the tips to thereby prevent fraying of each tip, the elastic core being formed of a plurality of individual strands made of natural rubber; and a selectively releasable cord lock having a housing and a plunger, the housing and the plunger both having throughholes through which the first and second ends of the cord are threaded to substantially form the elastic cord into two semicircular loops when the elastic cord is inserted through the throughholes of the apertured tabs;

the plunger being spring-biased to misalign the plunger throughhole and the housing throughhole to selectively frictionally grip, and thereby selectively releasably inhibit, the sections of the cord passing through the cord lock in an adjusted position relative thereto.

4. The elastic strap of claim 3 wherein the elastic core is formed from about 9 to about 15 individual strands.

* * * * *